US008028549B2

(12) United States Patent
Orue Orue et al.

(10) Patent No.: US 8,028,549 B2
(45) Date of Patent: Oct. 4, 2011

(54) CONTROL DEVICE FOR A WASHING MACHINE

(75) Inventors: Rodrigo Orue Orue, Vitoria-Gasteiz (ES); Fernando Sales Villalabeitia, Mondragón (ES)

(73) Assignee: Coprecitec, S.L., Barcelona (ES)

( * ) Notice: Subject to any disclaimer, the term of this patent is extended or adjusted under 35 U.S.C. 154(b) by 433 days.

(21) Appl. No.: 12/143,583

(22) Filed: Jun. 20, 2008

(65) Prior Publication Data

US 2008/0314090 A1 Dec. 25, 2008

(30) Foreign Application Priority Data

Jun. 21, 2007 (ES) ..... 200701334 U

(51) Int. Cl.
*D06F 33/02* (2006.01)

(52) U.S. Cl. ..... 68/12.14; 68/12.16

(58) Field of Classification Search ..... 68/12.14, 68/12.16

See application file for complete search history.

(56) References Cited

U.S. PATENT DOCUMENTS

| | | | | |
|---|---|---|---|---|
| 2,899,814 | A * | 8/1959 | Buechler | 68/12.18 |
| 3,143,501 | A * | 8/1964 | Worst | 210/380.2 |
| 3,551,072 | A * | 12/1970 | Zimmerly | 417/45 |
| 4,556,827 | A * | 12/1985 | Erdman | 318/400.3 |
| 5,434,491 | A * | 7/1995 | Marioni | 318/700 |
| 5,569,988 | A * | 10/1996 | Kokami et al. | 318/400.35 |
| 5,682,091 | A * | 10/1997 | Williamson et al. | 318/800 |
| 6,177,777 | B1 | 1/2001 | Piazzalunga | |
| 6,208,113 | B1 * | 3/2001 | Lelkes et al. | 318/807 |
| 6,239,563 | B1 * | 5/2001 | Kunz | 318/400.07 |
| 6,609,264 | B2 | 8/2003 | Ruhl et al. | |
| 6,854,299 | B2 | 2/2005 | Weinmann et al. | |
| 7,146,670 | B2 | 12/2006 | McGill et al. | |
| 2005/0091760 | A1 | 5/2005 | Do | |

FOREIGN PATENT DOCUMENTS

| | | |
|---|---|---|
| GB | 2274343 | 7/1994 |

* cited by examiner

*Primary Examiner* — Frankie L Stinson

(74) *Attorney, Agent, or Firm* — Tim L. Kitchen; Peter B. Scull; Berenbaum Weinshienk PC

(57) ABSTRACT

A device and method for controlling a drainage pump of a washing machine. The drainage pump is powered by a synchronous motor that is connected to a mains voltage bus by a switch. During one or more stages of a washing program the switch is operated to apply in each half cycle of the mains voltage a delay time from the zero setting of the mains voltage to cause the motor to operate in a cut-wave mode.

6 Claims, 2 Drawing Sheets

CONTROL DEVICE FOR A WASHING MACHINE

CROSS-REFERENCE TO RELATED APPLICATIONS

This application claims priority to Spanish Patent Application ES-U200701334, filed Jun. 21, 2007.

TECHNICAL FIELD

The present invention relates to a device for controlling a domestic washing machine, and more specifically to the control of a drainage pump of a washing machine.

BACKGROUND

Known washing machines comprise a drum that is rotated by means of a main motor in accordance with a speed order corresponding to the various phases of a washing program selected by a user, and a drainage pump with a discharge motor to drain the flow of water that has accumulated in the drum. The main motor is usually of the universal motor type, with the speed being regulated by phase control and tachometer feedback. The main motor is controlled by a control device that acts on a switch, normally a triac. The time reference that is normally used to carry out the phase control of the main motor is the zero setting of the mains voltage.

The control device also controls the discharge motor of the drainage pump, using a respective switch, normally a triac, to do so. The discharge motor is usually a synchronous permanent-magnet motor and is usually operated, through the triac, by an on-off control.

GB 2274343 describes a control device for a washing machine that controls the discharge motor of the drainage pump. The control device uses an on-off control to operate the discharge motor, in other words, the discharge motor is powered in the phases in which an amount of water has to be drained from the drum, with the discharge motor not being powered in the phases in which there is no water.

SUMMARY OF THE DISCLOSURE

The object of the invention is to provide a control device for a washing machine as defined in the claims.

The control device according to the invention is applied in washing machines which comprise a drum that is rotated by a main motor in accordance with a speed order corresponding to the various phases of a washing program selected by a user, and a drainage pump with a discharge motor to drain the flow of water that has accumulated in the drum, the discharge motor being a synchronous permanent-magnet motor.

The control device according to the invention controls the main motor and the discharge motor by means of respective switches through which a mains voltage may be applied to the motors. In certain phases of the overall washing program the control device acts on the switch of the discharge motor and applies, in each half-cycle of the mains voltage, a constant delay time from the zero setting of the mains voltage.

As a result, instead of applying an on-off control, as is the case of the prior art, an alternative method is used, which can be designated as a cut-wave mode, in which the aforementioned delay time in each half-cycle of the mains voltage, is applied with the effect that the effective voltage (or RMS voltage) applied to the discharge motor is reduced. Thus, in the washing program phases in which the discharge motor operates virtually without a load, that is, draining a minimum flow of water mixed with air, it can be opted for operating the discharge motor in this cut-wave mode, instead of continuing to power it from the mains voltage in full-wave mode and thereby waste energy in the process, or of stopping it altogether, which means that the motor has to be started again whenever water needs to be drained.

The supply of a smaller effective voltage to the discharge motor during certain phases reduces the power consumed by the discharge motor and thus prolongs the useful life of the discharge motor. Furthermore, by preventing the discharge motor from being powered by the mains voltage in the phases in which there is hardly any load, the vibrations and changes of speed resulting from the acceleration and deceleration of the rotor in the phase are reduced. In addition, the fact that the discharge motor is not continually being switched on, the discharge motor remaining in cut-wave mode instead of having to be switched off altogether, prevents sudden mechanical stresses caused by starting up this type of motor.

Given that the time reference that is normally used to control the main motor phase is the zero setting of the mains voltage, the control device already knows the zero setting points of the mains voltage. This makes it very easy to implement the invention in the control devices in the prior art, as all that needs to be done is set the value of the delay time to be applied, determine the phases corresponding to each washing program in which the cut-wave mode will be used, and apply the delay time based on the zero settings of the mains voltage (which are already known) in the phases. In practice, this merely involves using a timer to set the delay and adding an additional program to the control algorithm of the drainage pump.

As the delay time may be a preset constant and as the delay time is applied in accordance with the scheduled load (which depends on the phase of the washing program), it is not necessary to fit any additional sensor. In alternative embodiments, the delay time is not a constant but is variable.

These and other advantages and characteristics of the invention will be made evident in the light of the drawings and the detailed description thereof.

BRIEF DESCRIPTION OF THE DRAWINGS

Preferred embodiments of the present disclosure are described herein with reference to the drawings wherein.

DETAILED DESCRIPTION

The inventive control device 1 controls a main motor 2 that rotates a drum (not shown in the figures) in accordance with a speed order corresponding to the various phases of a washing program selected by a user, and also controls a discharge motor 3 of a drainage pump (not shown in the figures) in order to drain a flow of water that has accumulated in the drum, the discharge motor 3 being a synchronous motor. In one embodiment, the discharge motor 3 being a synchronous permanent-magnet motor.

Figure 1:
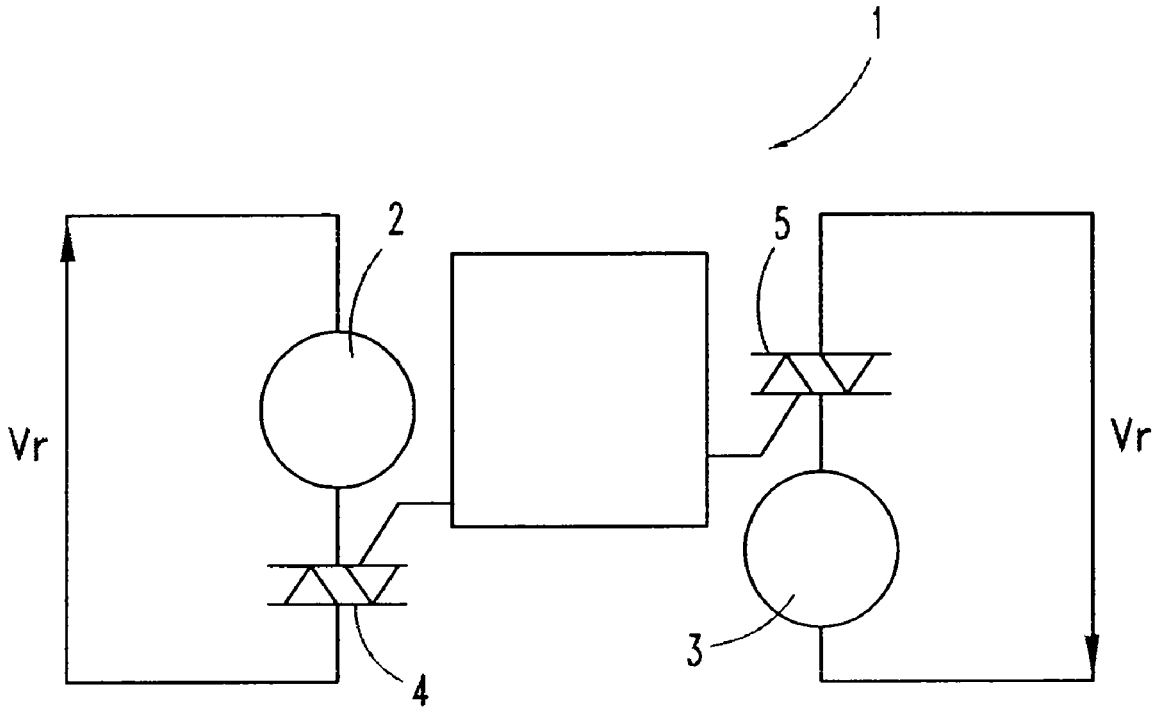
FIG. 1 shows a block diagram of a control device in one implementation.

As shown in the diagram in FIG. 1, the control device 1 controls the main motor by means of a switch 4 and controls the discharge motor 3 by means of a switch 5. Through the switches 4 and 5 located in the mains voltage bus, a mains voltage Vr may be applied to the main motor 1 and to the discharge motor 3 respectively. In a preferred embodiment the switches 4 and 5 are triacs.

Usually, the discharge motor 3 is operated by an on-off control, in other words, when "on" the mains voltage is applied to it and it thus operates in full-wave mode. Alternatively, when "off" no voltage is applied to it at all, as a result of which the discharge motor 3 stops. In certain phases of the washing program, specifically in the phases in which the water is not drained or the amount drained is minimal, the control device 1 according to the invention acts on the switch 5 of the discharge motor 3 and applies, in each half-cycle of the mains voltage Vr, a constant delay time Tr from the zero setting of the mains voltage Vr, causing the discharge motor 3 to operate in cut-wave mode.

Figure 2:
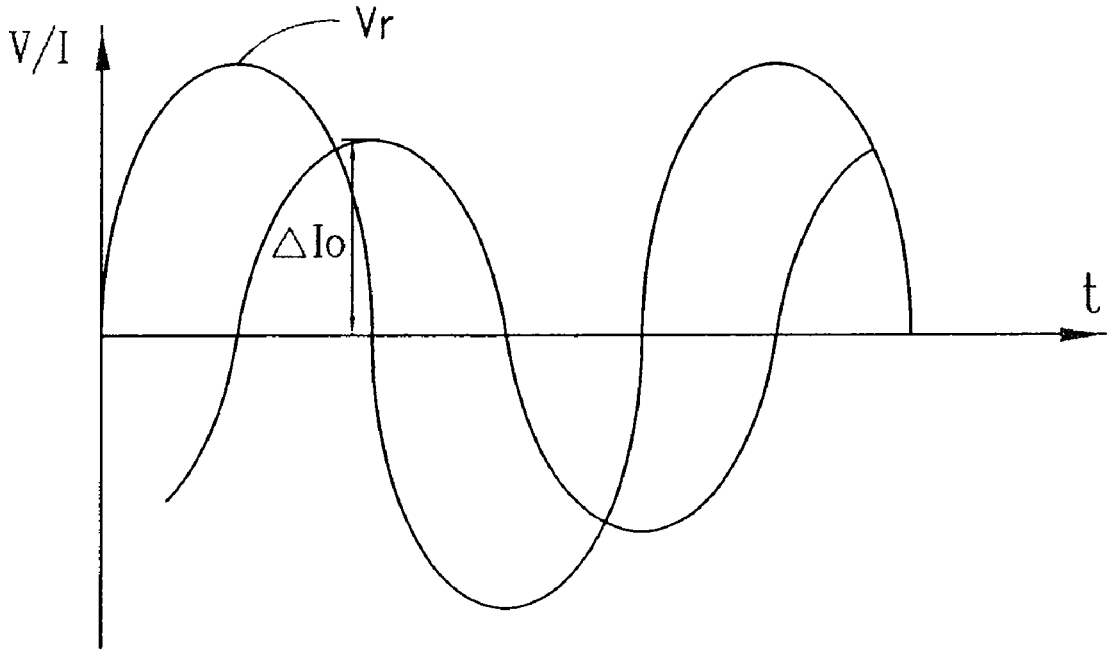
FIG. 2 shows a graph showing the mains voltage and the current powering the discharge motor when it is operating in full-wave mode.

When the control device 1 causes the drainage motor 3 to operate in full-wave mode, the switch 5 allows an uninterrupted passage of current and the current that is applied to the discharge motor 3 is the current shown in FIG. 2, which is a sinusoidal current with a specific delay in relation to the mains voltage due to the impedance of the discharge motor 3, to its rotor and its mechanical load, to the working point in the application and to the value of the actual frequency and the value of the voltage.

Figure 3:
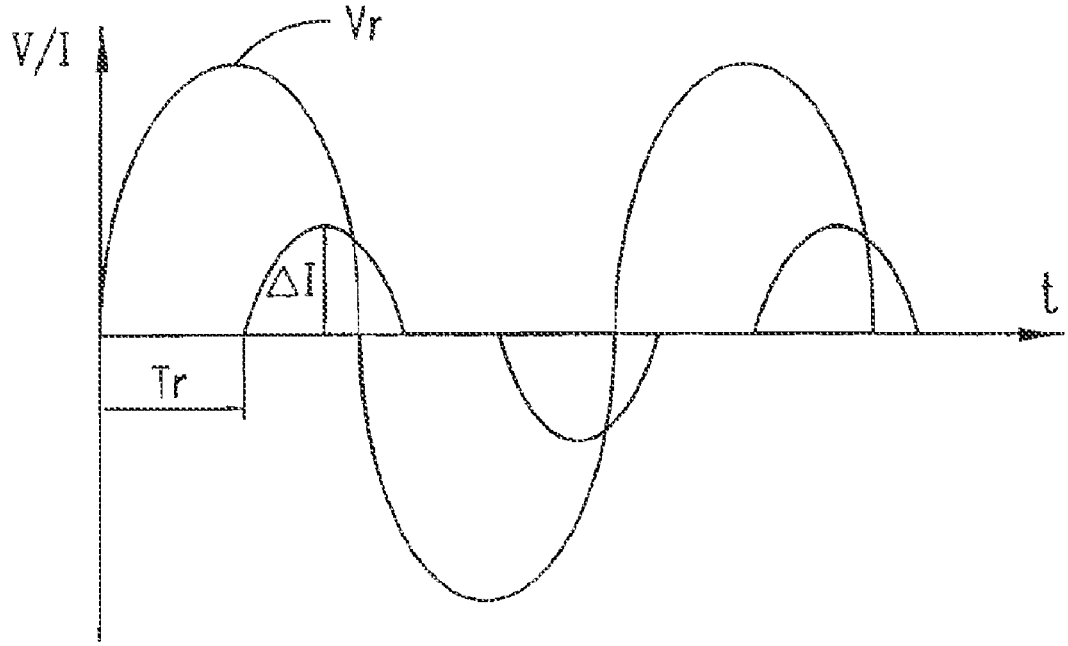
FIG. 3 shows a graph showing the mains voltage and the current powering the discharge motor when it is operating in cut-wave mode.

When the control device 1 causes the discharge motor 3 to operate in cut-wave mode, it includes the delay times Tr, with the result that the current applied to the discharge motor 3 is a current like that shown in FIG. 3. It can be seen that when applying the delay time Tr the wave amplitude $\Delta I$ of the current in the discharge motor is smaller than the wave amplitude $\Delta Io$ in full-wave mode, with the result that the power consumed by the motor 3 in this cut-wave mode is less than the power consumed in full-wave mode. In addition, given that the leakage in the copper of the discharge motor 3 is proportional to the square of the current, the leakage is also reduced as well as the leakage in the iron, thus extending the useful life of the discharge motor 3.

A value below a critical time is chosen for the delay time Tr, this value being the delay time from which the voltage supplied to the discharge motor 3 is not sufficient for it to maintain the rotor speed in synchronism with the rotating magnetic field of the stator. The synchronism leakage voltage basically depends on the constructive characteristics of the discharge motor, the hydraulic load, the frequency of the mains voltage and the value of the mains voltage. To ensure that the discharge motor 3 does not stop when operating in cut-wave mode, a safety margin is established between the critical time and the selected delay time Tr.

At all times, the control device 1 knows the phase in which the washing program is found and may therefore cause the discharge motor 3 to work in the most appropriate mode in each phase. The operating of the discharge motor 3 can be optimised by causing it to switch to the cut-wave mode in the phases in which the flow of water required from the pump is minimal.

Thus, during the centrifugation stage in the phases in which the flow of water is predicted to be minimal, the discharge motor 3 operates in cut-wave mode. The phases in which the flow is minimal are those following the phases in which there is a continual increase in the speed order of the drum rotation. When the speed order increases water must be drained, and therefore full-wave mode is used, but by the time the speed order stops increasing, most of the water has already been drained, as a result of which the control device 1 may operate the discharge motor 3 in cut-wave mode, with the delay time Tr therefore being applied.

In a preferred embodiment, the control device 1 introduces a waiting time before beginning to apply the delay time Tr, from the moment at which the speed order of the drum rotation stops increasing.

Furthermore, in the washing stage, which precedes the centrifugation stage, discharge stages are included and in which the discharge motor 3 has to operate in full-wave mode. When the discharge stages are about to conclude, more specifically after the level of water that has accumulated in the drum reaches a preset level H, the control device 1 may begin to apply the delay time Tr.

In a preferred embodiment, the control device 1 introduces a waiting time before beginning to apply the delay time Tr, from the moment at which the level of water of the drum reaches the level H during the washing stage.

During the washing stage, there is also option of causing the discharge motor 3 to function with the on-off control, the use of the half-wave mode being reserved solely for the centrifugation stage. In such an event, the discharge motor 3 begins the centrifugation stage by operating in full-wave mode in order to ensure the discharge motor 3 starts.

Figure 4:
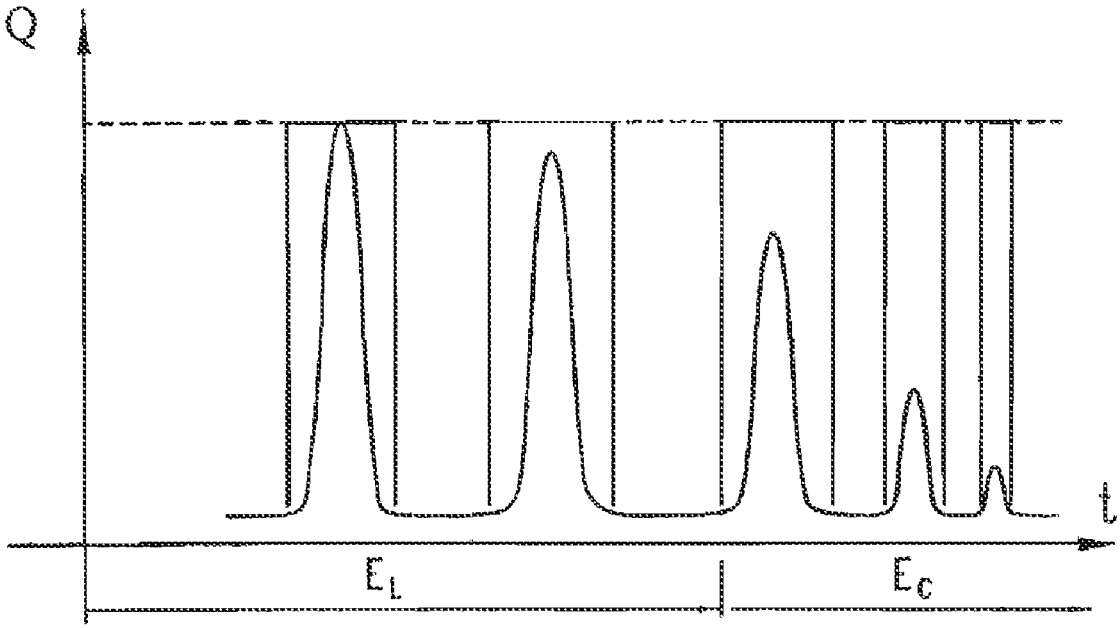
FIG. 4 shows an example of the various phases of a washing program, detailing the phases in which the discharge motor operates in full-wave mode and the phases in which it operates in cut-wave mode.

FIG. 4 shows an example of a washing program in which the flow of water Q displaced by the discharge motor 3 during the program is shown. A continuous line is used to indicate the phases in which the full-wave mode is used and a broken line is used to indicate the phases in which the cut-wave mode is used. It can be seen that the cut-wave mode is used in the phases in which the flow of water that has accumulated is minimal.

What is claimed is:

1. A washing machine comprising:

a drum coupled to a main motor that is electrically coupled to a mains A/C voltage bus, the drum rotatable by the main motor in accordance with a speed order corresponding to various stages of a washing program, one stage being a centrifugation stage that occupies a first time interval of the washing program;

a drainage pump to drain water from the drum, the drainage pump driven by a synchronous motor that is powered by the mains A/C voltage bus, the synchronous motor of the drainage pump controlled by a first switch in the mains voltage bus; and a control device operably coupled to the switch and programmed to act on the switch, without consideration to the magnetic field amplitude of the synchronous motor, to cause the switch to apply in each half cycle of the mains A/C voltage a delay time from the zero setting of the mains A/C voltage to cause the synchronous motor of the drainage pump to operate in a cut-wave mode during at least a portion of the first time interval.

2. A washing machine according to claim 1 wherein the control device is operable to act on the switch in a manner to cause the synchronous motor of the drainage pump to operate in full-wave mode at the beginning of the first time interval.

3. A washing machine according to claim 1 wherein the synchronous motor is a synchronous permanent-magnet motor.

4. A washing machine according to claim 1 wherein the delay time is a preset constant time.

5. A washing machine according to claim 1 wherein the main motor is operably controlled by a second switch in the mains A/C voltage bus.

6. A washing machine according to claim 5 wherein the control device is coupled to and controls the second switch.

* * * * *